US005127754A

United States Patent [19]

Mase

[11] Patent Number: 5,127,754

[45] Date of Patent: Jul. 7, 1992

[54] WRITING INSTRUMENT'S CAP WITH SAFETY VENT

[75] Inventor: Kimihiko Mase, Aichi, Japan

[73] Assignee: The Pilot Ink Co., Ltd., Aichi, Japan

[21] Appl. No.: 753,768

[22] Filed: Sep. 3, 1991

[30] Foreign Application Priority Data

Sep. 18, 1990 [JP] Japan ..... 2-97788[U]

[51] Int. Cl.[5] ..... B43K 9/00

[52] U.S. Cl. ..... 401/202; 401/213; 401/243; 401/247

[58] Field of Search ..... 401/202, 213, 243, 247

[56] References Cited

U.S. PATENT DOCUMENTS

| | | | |
|---|---|---|---|
| 4,018,536 | 4/1977 | Brenner | 401/247 X |
| 4,643,605 | 2/1986 | Iwasaki | 401/247 X |
| 4,969,766 | 11/1990 | Nagle et al. . | |
| 5,000,603 | 3/1991 | Isoda | 401/243 X |
| 5,000,604 | 3/1991 | Isoda | 401/243 X |

FOREIGN PATENT DOCUMENTS

| | | | |
|---|---|---|---|
| 2312168 | 3/1973 | Fed. Rep. of Germany | 401/202 |
| 2818477 | 10/1979 | Fed. Rep. of Germany | 401/202 |
| 3821195 | 8/1990 | Fed. Rep. of Germany . | |
| 1391958 | 4/1988 | U.S.S.R. | 401/213 |
| 2215279 | 2/1989 | United Kingdom . | |
| 2229967 | 10/1990 | United Kingdom | 401/243 |
| 8911978 | 12/1989 | World Int. Prop. O. | 401/213 |

*Primary Examiner*—Steven A. Bratlie
*Attorney, Agent, or Firm*—Sughrue, Mion, Zinn, Macpeak & Seas

[57] ABSTRACT

A writing instrument's cap includes a main cylinder; and an inner cylinder fixedly fitted in the main cylinder includes: a cup-shpaed upper portion having a bottom, an annular flange provided to an upper end thereof, and a large diameter portion provided below the annular flange; and a cylindrical lower portion extended from the bottom of the cup-shaped upper portion in such a manner that the cylindrical lower portion is opened at the other end, wherein a vent member for communicating an interior of the cap with an outside air is provided to a wall of the cup-shaped upper portion.

1 Claim, 1 Drawing Sheet

WRITING INSTRUMENT'S CAP WITH SAFETY VENT

BACKGROUND OF THE INVENTION

This invention relates to the caps of writing instruments more particularly it relates to the cap of a writing instrument (hereinafter referred to as "a writing instrument's cap", when applicable) which has a vent structure for preventing suffocation of an infant if the cap of a writing instrument is swallowed by accident.

A writing instrument's cap having such vent has been disclosed in the art (cf. DT Patent No. 3821195, U.S. Pat. No. 4,969,766, and UK Patent Laid-Open No. 2215279). The cap is of a dual structure having a main cylinder and an inner cylinder. A gap is formed in the junction of the main cylinder and the inner cylinder to establish communication between the interior of the cap and the ambient atmosphere.

However, a writing instrument's cap having a vent structure in its inner cylinder has not been disclosed yet.

In the above-described conventional writing instrument's cap, it is difficult to form the main cylinder of metal or wood.

SUMMARY OF THE INVENTION

Accordingly, an object of this invention is to provide a writing instrument's cap with a vent structure which can be readily formed irrespective of the material of the main cylinder.

A writing instrument's cap 1 according to the invention comprises: a main cylinder 2 and an inner cylinder 3. In the writing instrument's cap, the inner cylinder 3 is molded from a plastic material. The inner cylinder 3 is made up of a cup-shaped upper portion 31 with a bottom 36, which includes an annular flange 32 at the upper end, and a large diameter portion 33 below the annular flange 32. The outside diameter of the inner cylinder is equal to or slightly larger than the inside diameter of the main cylinder 2 and is larger than the outside diameter of the remaining portion of the inner cylinder. A cylindrical lower portion extends from the bottom 36 of the cup-shaped upper portion in such a manner that it is opened at the outer end. The inner cylinder is fixed in the main cylinder with the flange 32 locked to the upper end face of the main cylinder 2. At least one opening 34 is formed in the wall of the cup-shaped upper portion 31 to provide communication between the interior of the cap and ambient air.

In the writing instrument's cap thus constructed, the inner cylinder 3 is fixed to the main cylinder 2 with its large diameter portion 33 press-fitted in the main cylinder 2, in such a manner that a gap is formed between the inner wall of the main cylinder's lower portion and the outer wall of the inner cylinder 3.

The dimension, the number, and the configuration of the above-described opening 34 is suitably determined from the size and configuration of the inner cylinder so that the quantity of airflow is at least 8 liters/minute with a maximum pressure difference of 1.33 kPa (British Standard 7272:1990).

When necessary, a clip 21 is connected to the cap, or it is formed integral with the cap.

When the cap 1 is placed on the writing instrument 4, the pen point portion of the latter 4 is hermetically held in the lower portion (or the cylindrical lower portion) of the inner cylinder 3. Even in the case where the cap 1 is caught at the windpipe of an infant having been swallowed by accident, the infant will not be suffocated thereby, because, as was described above, the interior of the cap is communicated with the outside air through the opening 34 formed in the wall of the cup-shaped upper portion of the inner cylinder, and the opening 34 is not brought into direct contact with the surface of the windpipe. That is, it is never closed by the surface of the windpipe. In other words, the infant is prevented from being suffocated by the cap caught at the windpipe, because he can still inhale and exhale through the cap.

DETAILED DESCRIPTION OF THE PREFERRED EMBODIMENTS

Figure 1:
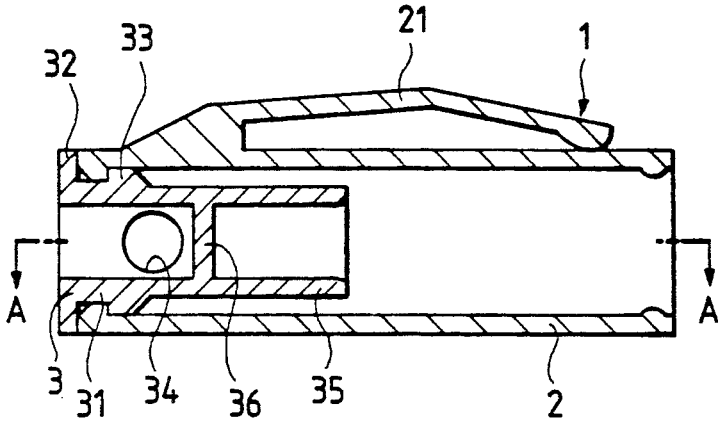
FIG. 1 is a longitudinal sectional view of an example of a writing instrument's cap according to the invention.
Figure 3:
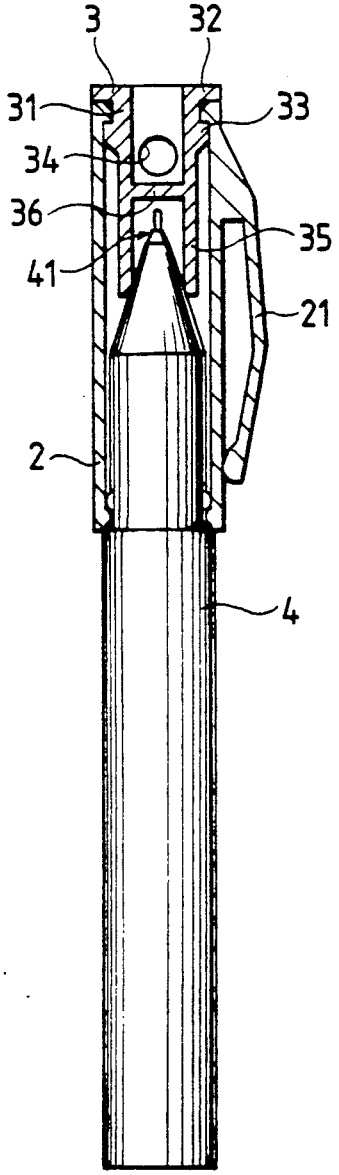
FIG. 3 is an explanatory diagram showing the writing instrument's cap put on the writing instrument.
Figure 2:
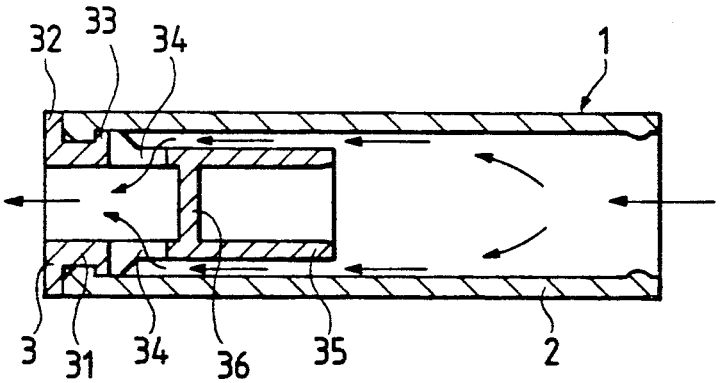
FIG. 2 is a sectional view taken along line A—A in FIG. 1.

One preferred embodiment of this invention will be described with reference to the accompanying drawings (FIGS. 1 through 3).

As shown in FIGS. 1 through 3, a writing instrument's cap 1 of the invention comprises: a main cylinder 2; and an inner cylinder 3 fitted in the former 2.

The inner cylinder 3 is made up of an upper portion, namely, a cup-shaped portion 31, and a lower portion, namely, a cylindrical portion 35 extended from the cup-shaped portion 31. The cup-shaped portion 31 has an annular flange 32 at the outer end. The body of the cup-shaped portion 31 is increased in outside diameter below the annular flange 32, thus forming a large diameter portion 33. The inner cylinder 3 is fixed in one end portion of the main cylinder 2. The main cylinder 2 has an annular protrusion extending radially inwardly from its inner wall. With the annular protrusion, the inner cylinder 3 is positively engaged with the main cylinder 2. Two circular openings 34 3 mm in diameter are formed in the wall of the cup-shaped portion 31 in such a manner that they are diametrically opposite to each other, so as to establish communication between the interior of the cap and the ambient air.

The cup-shaped portion 31 has a bottom 36. The cylindrical portion 35 is extended from the bottom 36. That is, one end of the cylindrical portion 35 is closed with the bottom 36, and the other end is opened. When the pen point portion 41 of a writing instrument 4 is inserted into the cap 1, the cylindrical portion 35 is hermetically sealed therewith.

The outside diameter of the lower portion of the inner cylinder 3, which extends from the large diameter portion 33, is smaller than the inside diameter of the main cylinder 2, so that, when the inner cylinder 3 is fitted in the main cylinder 2, a gap is formed between the inner cylinder 3 and the main cylinder 2. The gap is a vent to communicate the interior of the cap with the openings 34.

In FIG. 2, the arrows indicate the air flow when the writing instrument's cap 1 is caught in a windpipe. It goes without saying that air may flow in the opposite direction.

The essential function of the writing instrument's cap is to hermetically hold the pen point portion of the writing instrument. This function is maintained by the lower portion (i.e., the cylindrical portion) of the inner cylinder. Since the upper portion (i.e., the cup-shaped portion) of the inner cylinder has the openings in its side wall, the interior of the cap communicates with the ambient air at all times. Even if the writing instrument's cap swallowed by an infant by accident is caught in the windpipe, the infant will never be suffocated thereby because the openings formed in the wall of the inner cylinder are not brought into direct contact with the surface of the windpipe.

The main cylinder is in the form of a pipe, which can be manufactured with ease irrespective of its material. By combining the main cylinder with the inner cylinder, the writing instrument's cap with the vent means is formed.

What is claimed is:

1. A writing instrument's cap comprising:

a main cylinder; and an inner cylinder molded from a plastic material and fixed in said main cylinder at one end, said inner cylinder comprising:

a cup-shaped upper portion including a bottom, an annular flange provided to an upper end thereof, and a large diameter portion provided below said annular flange, said inner cylinder being fixed in said main cylinder with said annular flange locked to the upper end face of said main cylinder and the remaining portion inserted into said main cylinder, wherein an outside diameter of said large diameter portion is equal to or slightly larger than an inside diameter of said main cylinder and is larger than an outside diameter of a remaining portion of said inner cylinder; and a cylindrical lower portion extended from said bottom of said cup-shaped upper portion and opened at the other end, wherein at least one opening is provided to a circumferential wall below said large diameter portion of said cup-shaped upper portion, such that ventilation axially through an inner space of the cap is secured during removal of the cap from a writing instrument.

* * * * *